US005279675A

United States Patent [19]

Verbeek

[11] Patent Number: 5,279,675

[45] Date of Patent: Jan. 18, 1994

[54] METHOD OF, AND APPARATUS FOR, CLEANING A TANK

[75] Inventor: Diederik S. Verbeek, Delft, Netherlands

[73] Assignee: Technische Universiteit Delft, Netherlands

[21] Appl. No.: 839,758

[22] PCT Filed: Oct. 12, 1990

[86] PCT No.: PCT/NL90/00150

§ 371 Date: May 27, 1992

§ 102(e) Date: May 27, 1992

[87] PCT Pub. No.: WO91/05620

PCT Pub. Date: May 2, 1991

[30] Foreign Application Priority Data

Oct. 13, 1989 [NL] Netherlands ..... 8902545

[51] Int. Cl.[5] ..... B08B 9/093; B05B 3/06

[52] U.S. Cl. ..... 134/22.1; 134/22.18; 134/24; 134/32; 134/167 R; 134/168 R

[58] Field of Search ..... 134/22.1, 22.18, 24, 134/32, 34, 167.R, 168.R

[56] References Cited

U.S. PATENT DOCUMENTS 2,681,250 6/1954 Metcalf et al. ..... 134/167 R
3,741,808 6/1973 Stalker ..... 134/58 R
3,874,594 4/1975 Hatley ..... 134/167 R
3,878,857 4/1975 Heibo ..... 134/167 R
4,859,249 8/1989 Valentini ..... 134/168 R

*Primary Examiner*—Theodore Morris
*Assistant Examiner*—Saeed T. Chaudhry
*Attorney, Agent, or Firm*—Peter L. Michaelson; Raymond R. Moser, Jr.

[57] ABSTRACT

Method and apparatus for cleaning a storage or transport tank by spraying a cleaning agent against the interior wall using at least one spray nozzle, said nozzle making a rotating movement in a plane, while said plane is simultaneously revolved around an axis which makes an angle with the axis of rotation of the nozzle, the point of impingement of a jet cleaning agent delivered by the nozzle describing a track over the interior wall of the container, said track passing a plurality of times a closed circumferential line on the wall of the tank, which line is chosen as a reference, wherein the nozzle or each nozzle is so controlled that passages of the impingement track that is being described substantially occur in the greatest as yet unintersected portion of said circumferential line, which portion is located between earlier points of intersection of the impingement track and said circumferential line namely, at distances from said earlier points of intersection which substantially bear a ratio of $1:(\frac{1}{2}\sqrt{5}-\frac{1}{2})$.

5 Claims, 5 Drawing Sheets

METHOD OF, AND APPARATUS FOR, CLEANING A TANK

TECHNICAL FIELD OF THE INVENTION

This invention relates to a method of cleaning a storage or transport tank or similar receptacle by spraying a cleaning agent against the interior wall using at least one spray nozzle, said nozzle making a periodic rotating movement in a plane while said plane is simultaneously revolved around an axis which makes an angle with the axis of rotation of the nozzle, the point of impingement of the jet of cleaning agent delivered by the nozzle or each nozzle describing a track over the interior wall of the tank, said track passing a plurality of times an imaginary continuous circumferential line on the wall of the tank, which line is chosen as a reference.

Such a method, as for example disclosed in GB-A-1,241,547, has long been used and the invention aims to improve the known method in the sense that in a shorter time a greater fraction of the contaminations is removed from the tank wall.

BACKGROUND ART

Before the invention is described, some relevant technical concepts will be defined.

The movements of the nozzles of a tank washing machine can generally be described as a periodic rotating movement in a plane while that plane itself is revolved around an axis which makes an angle with the axis of rotation of the nozzle. As far as is known, in all known machines the two axes of rotation are mutually perpendicular. The machines in which the two rotating movements are uniform and rotate completely, are known as so-called "Butterworth" machines In other machines the rotating movement of the spray nozzles in the plane is not uniform and completely rotating but covers only a portion of the circle and can be described as a backward and forward movement. Examples thereof are the so-called "bottom washers" and some "single nozzle machines".

Although the aforementioned axes of rotation which define the movements of the nozzle can be disposed in any desired position in the space and the movements can be such that, if desired, any portion of the space or the entire space can be covered by the jets of cleaning agent, for the sake of simplicity reference will be made to a horizontal axis which nozzles rotate about uniformly and completely, and a vertical axis which the vertical plane of rotation of the nozzles revolves around uniformly. The respective rates of rotation are designated $\Omega_h$ and $\Omega_v$.

Although, further, any drive of rotation can be used for rotating one or more nozzles around two or more axes, hereinafter reference will be made only to a (fixed) bevel gear with a vertical axis (number of teeth $=N_f$), over which rolls, as a planet gear, a (moving) bevel gear with a horizontal axis (number of teeth $N_m$). In the case where the transmission ratio between the two gear nozzle rotations is in actual fact effected by means of gears, the relation between "horizontal" and "vertical" rotation can be described as:

$$T_v T_h = \Omega_h / Q_v = N_f / N_m$$

wherein $T_v$ and $T_h$ represent the period (period of oscillation or time of revolution) of the movements for the vertical and the horizontal axis of rotation, respectively.

The trajectory of jet impingement of one nozzle in one revolution about the horizontal axis is called a track. The width of the area cleaned by the nozzle jet is dependent upon many factors, such as distance, angle of incidence, nature and adhesion of the material to be removed to the tank wall, etc.

Due to the simultaneous rotation of the nozzle around two axes, the beginning and the end of each track, to be defined as intersections of a closed circumferential line on the tank wall, chosen as a reference, will have shifted relatively to each other. The extent of the shift depends on $T_v / T_h$.

Depending on the number of nozzles $N_{noz}$, after a number of shifts the washing pattern will have made one complete round along the closed reference line and the first subsequent intersection of a nozzle jet track will occur beyond the intersection that was the first to be defined. Then one subcycle has been completed. A full cycle has been completed when after a number of rounds $N_{track}$ the last intersection coincides with the first. When the intersections are provided so close to each other that the shift along the closed reference line is approximately equal to the width of the jet impingement trajectory, theoretically one single cycle will suffice. In practice a complete cycle is built up from a number of subcycles, the intersections of the tracks at the closed reference line having shifted a little in each successive subcycle over a distance which is so much smaller than the distance between successive intersections in the preceding subcycle that this distance can be bridged in a number of steps in one direction. In other words, in the first subcycle a track pattern is created which is gradually densified from one side. Only after a complete cycle has been completed is a track pattern obtained of a certain density and uniformly distributed over the interior tank wall, in which the impingement tracks can overlap laterally.

Therefore, it is a drawback of the known tank cleaning method that only after a relatively long washing time a uniform dense impingement track pattern is provided so that in the case of premature interruption of the cleaning process only a small fraction of the contaminations have been removed from the tank wall.

SUMMARY OF THE INVENTION

According to the invention this drawback can be avoided in virtue of the fact that the nozzle or each nozzle is so driven that the impingement track passes the continuous circumferential or reference line substantially in the greatest as yet un-intersected portion of said circumferential line, which portion is located between earlier points of intersection of the impingement track and said circumferential line, namely at distances from said earlier points of intersection which substantially bear a ratio of $1:(\frac{1}{2}\sqrt{5}-\frac{1}{2})$.

The number $\frac{1}{2}\sqrt{5}-\frac{1}{2}$ is known as the Golden Section ($GS \approx 0.618$). In the method according to the invention, in principle each subsequent track is applied approximately centrally in the greatest as yet uncovered area, so that the density of the track pattern increases uniformly and already after a very short time a relatively large fraction of the contaminations has been removed from the tank wall. After prolonged washing there is no difference between the present method and the above described known technique, but according to the invention a faster increase in density is accomplished owing to a different spatial sequence of applying the tracks.

In further elaboration of the invention at the latest in the fourth period of the rotating movement of the spray nozzles, an intersection of the continuous or reference line by the impingement tracks of the jets of cleaning agent takes place in such a way that the space between two preceding intersections is divided into sections whose dimensions substantially bear a ratio of $1:(\frac{1}{2}\sqrt{5}-\frac{1}{2})$.

Then, in principle each subsequent intersection will divide the corresponding interspace in the aforementioned ratio.

When thus the first intersections of the impingement tracks and the reference line are not applied in accordance with the Golden Section principle, the option is obtained of providing already at the beginning of the first subcycle, some uniformly distributed tracks in the tank surface, as yet very large and uncovered, which coarse pattern is subsequently densified according to the GS principle.

It is observed that the reference line must be chosen such that during each period of the aforementioned periodic rotating movement in the rotating plane it is intersected once in one direction and once in the other direction by the impingement track of the jet of cleaning agent which issues from at least one of the spray nozzles, and that all intersections in one direction occur at the same relative time within the period in all periods of said periodic rotating movement, each subsequent intersection having in principle shifted over a fixed distance along the reference line.

Because, further, the Golden Section number cannot be written as a fraction of two integers, it is impossible to effect, using gears, the tracks' dividing interspaces in sections whose ratios of width are exactly equal to the Golden Section.

The best approximation is achieved by means of a design rule in which an arithmetic series is used—namely the Fibonacci series, which is defined as:

$$F_{i+1}=F_i+F_{i-1},$$

with $F_0=F_1=1$.

The terms $F_i$ ($i=0,1,2,3, \ldots$) of the series are: 1,1,2,3,5,8,13,21,34,55,89,144,233,377,610,987,1597,2584, $$F_i/F_{i+j} \approx GS^j$$

When choosing $j=1$ or $j=-1$, the numbers $F_j$ and $F_{i+j}$ bear a ratio approximately equal to the GS. The higher the value of i is selected to be, the better the approximation. When $F_9=55$ and $F_{10}=89$, the relative deviation is already less than $10^{-4}$. It is also possible, however, to choose $j=+2$ or $-2$, since owing to the remarkable properties of this number it holds for the remaining portion of the GS that $1-GS=GS^2$.

The following is a good design rule for the expression of the $\approx$GS ratio, obtained by dividing two consecutive terms in the Fibonacci series, which represent numbers of teeth of gears:

$$\frac{N_f}{N_m}=\frac{\Omega_h}{\Omega_v}=\frac{T_v}{T_h}=\frac{F_i+kF_{i+j}}{N_{noz}F_{i+j}},$$

wherein:

$i=\{0,1,2,3, \ldots\}$ (recommended i as high as possible, $i>8$)

$j=\{\ldots -1,0,1,2, \ldots\}$ (recommended $j=(-2,-1,1,2)$ $k=\{\{\ldots -1,0,1,2\}$ (recommended $k=0,1, \ldots ,N_{noz}$)

In this design rule account is taken of the circumstance that each next track starting-point at the reference line comes from another nozzle. In determining the gear ratio, it must be taken into account that $N_m$ should not be divisible by $N_{noz}$.

When choosing $k\neq 0$, not the second intersection but for instance the third or fourth intersection will divide the then largest uncovered area in sections which have a ratio according to GS. As long as $k\leqq N_{noz}$, the deviation from the GS will be acceptable in practice.

The ratio of the sections which the as yet unintersected portions of the reference line are divided into, has a course according to the following series in a machine which satisfies the Golden Section principle as much as possible:

1 time $F_{i-1}:F_{i-2}$,
1 time $F_{i-2}:F_{i-3}$,
2 times $F_{i-3}:F_{i-4}$,
.
.
.
$F_{i-4}$ times 5 : 3
$F_{i-3}$ times 3 : 2
$F_{i-2}$ times 2 : 1
$F_{i-1}$ times 1 : 1

This is to say that the division ratio at the beginning of the washing cycle is almost equal to 1:GS. At the end of the cycle, the deviation from GS has such a course that the sections of the reference circle, which have become very small by then, are impinged in the centre. If one had nevertheless been able to accomplish an exact approximation of the number GS in the transmission, the division would remain equal to it into infinity.

Because with the passage of time more and more tracks are made, the number of interspaces of the reference circle increases too and more and more tracks must be provided before a refinement of the track pattern has taken place. After each refinement the largest and the smallest unintersected part of the reference circle bear a ratio which is substantially equal to 1:GS.

The number of tracks that must be made for a next step in the refinement follows the series $F_0$, $F1$, $F_2$, ...

A track pattern in which the first tracks are not yet applied according to the Golden Section principle, corresponding to $K\neq 0$, also exhibits such steps in the refinement, although they do not occur right from the start.

A machine according to the invention exhibits at least four of such steps in the track pattern.

BRIEF DESCRIPTION OF THE DRAWINGS

One embodiment of the tank cleaning apparatus according to the invention will now be explained and illustrated with reference to the accompanying drawings, in which.

DETAILED DESCRIPTION OF THE INVENTION

Figure 1:
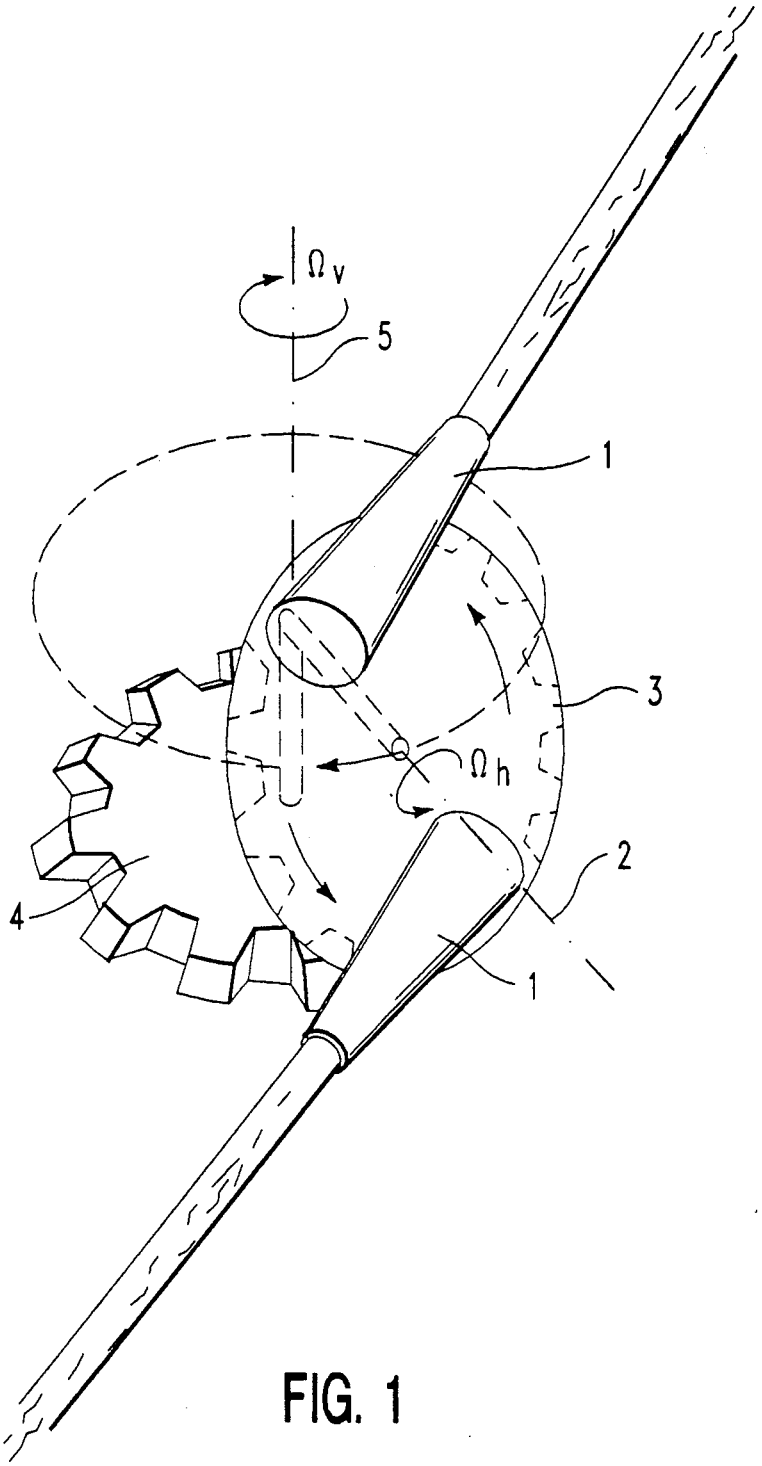
FIG. 1 schematically shows two nozzles which are driven for simultaneous rotation around two axes by means of cooperating bevel gears.

An assembly of two nozzles 1 in the embodiment as shown in FIG. 1 is rotatable on a horizontal axis 2 in a substantially vertical plane which in this Figure is defined by a side of a bevel gear 3. The bevel gear 3 rolls over another bevel gear 4 whose position is substantially horizontal and stationary. During the rolling movement of the vertical gear 3 over the horizontal gear 4, the nozzles 1 make a composite movement in which they simultaneously rotate about the horizontal axis 2 at a velocity $\Omega_h$ and about a vertical axis 5 at a velocity $\Omega_v$.

Figure 2:
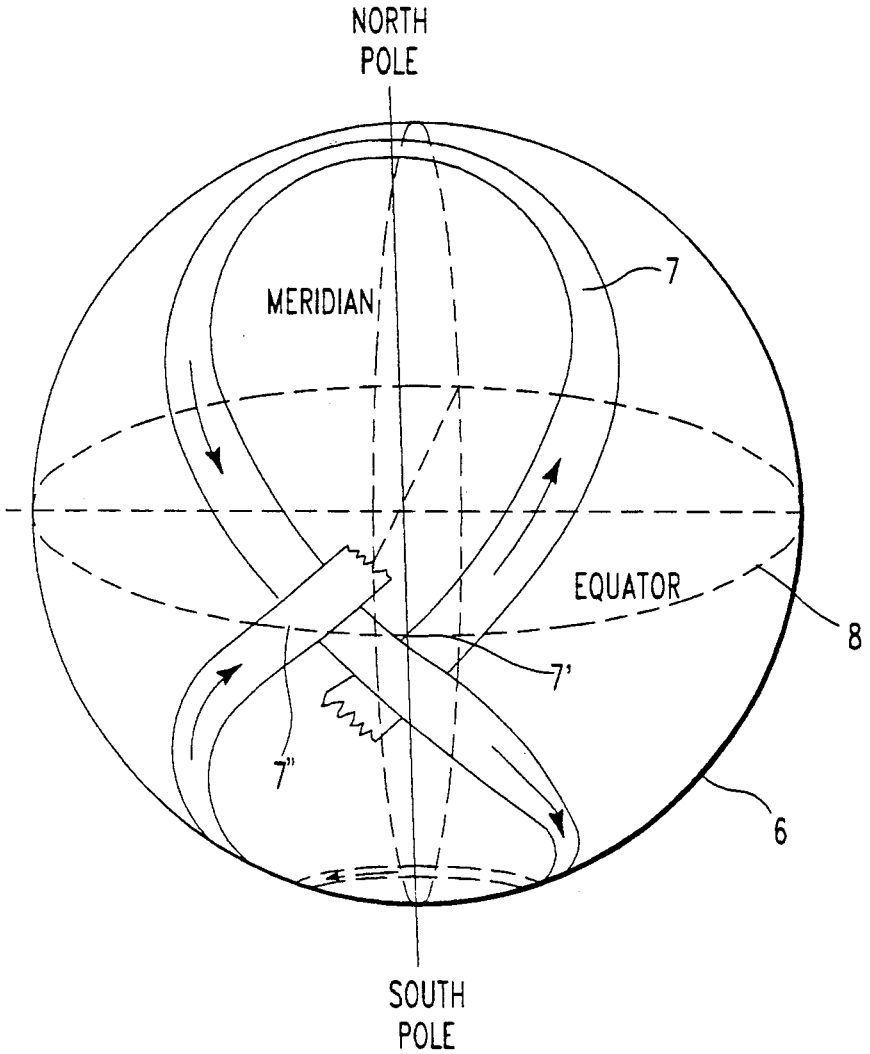
FIG. 2 shows a jet impingement track of one nozzle in a spherical tank.

In a spherical tank 6, in each revolution of the vertical bevel gear 3, one nozzle 1 produces a jet impingement track 7, of which FIG. 2 shows an example. Relatively to a closed reference line 8, the equator of the sphere 6 having been selected here to serve as such, the starting-point 7' and the terminal point 7'' of the track 7 are shifted relatively to each other.

Figure 3:
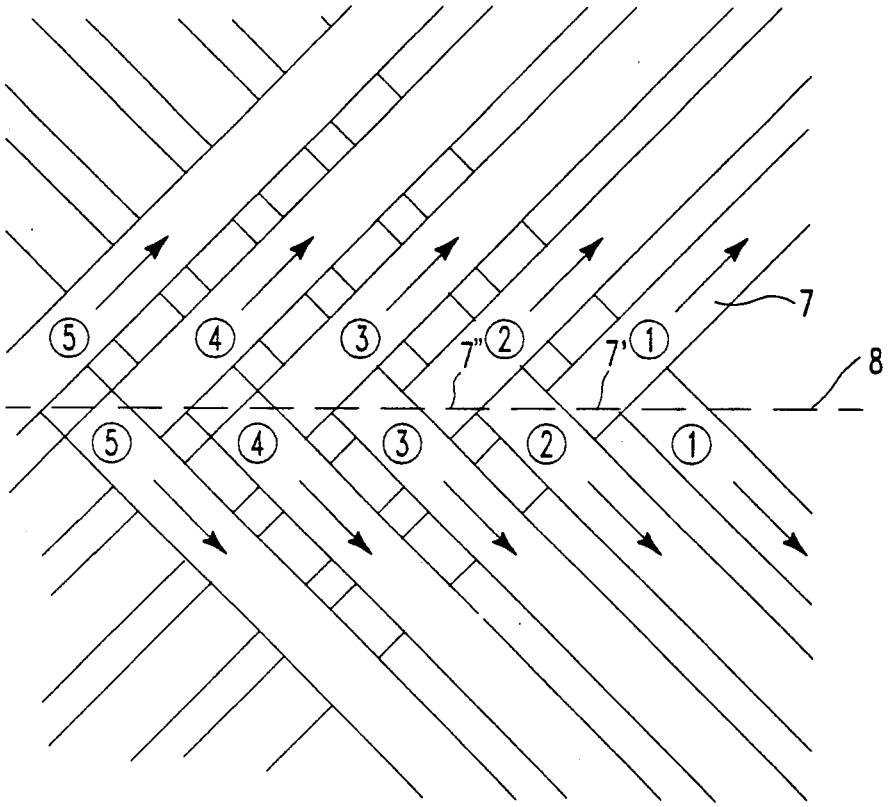
FIG. 3 shows a number of intersections of jet impingement tracks at a reference line on the interior wall of the tank in the track pattern of a conventional machine.

FIG. 3 shows how a uniform track pattern can be applied to a tank wall with such stepwise shifting tracks.

Figure 4A:
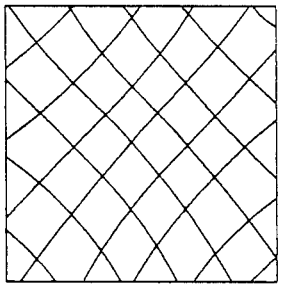
FIG. 4A-D show the stepped densification of the track pattern in a conventional machine.
Figure 4B:
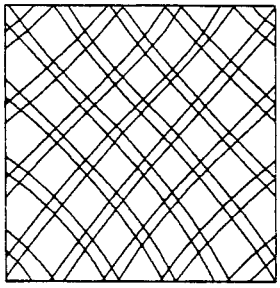
Figure 4C:
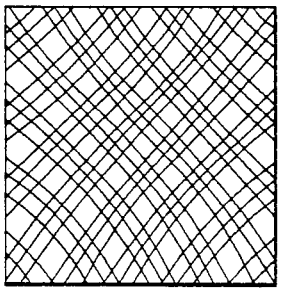

FIG. 4A shows the result of a subcycle completed in accordance with FIG. 3. It starts from the coarse-meshed pattern according to FIG. 4A which is obtained after one round along the reference circle 8 (subcycle) by greater track shifts than shown in FIG. 3. The second subcycle is started after a shift of a quarter of the track shift in the first subcycle and results in the pattern according to FIG. 4B. After yet another subcycle the pattern looks as shown in FIG. 4C and the complete cycle is finished in FIG. 4D.

In summary, FIG. 3 shows the composition of the track pattern in the first subcycle, while FIG. 4 shows the composition of a dense pattern through subcycli stepwise shifting in one direction.

The present invention is different from that prior art technique in that successive jet impingement tracks are applied in a spatially different sequential order, using the Golden Section principle.

Figure 5:
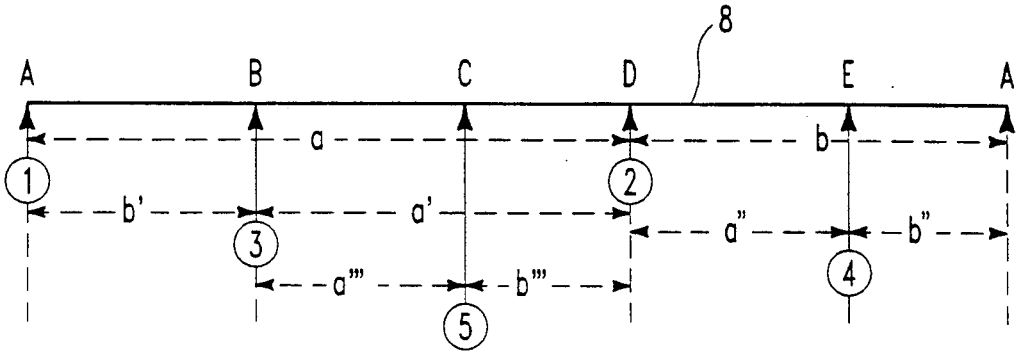
FIG. 5 schematically illustrates a densification of the track pattern that is uniform along the entire tank circumference in a machine according to the invention.

In FIG. 5 the closed reference line 8 is drawn as a straight line A,B,C,D,E,A. The starting-points of successive tracks are circled and indicated by means of sequential numbers.

After the first intersection of the reference line 8 by a track at A, the as yet unintersected length of the reference line equals the total length A—A of the line 8.

The second passage occurs at D so that the length of the line 8 is divided in sections a and b which bear the ratio of the Golden Section, i.e. $\approx 0.618$. This requires a track shift from A to D of a length a. After a similar track shift a from D in the direction E, the third intersection occurs at B, with the result that the as yet largest, unintersected part of the reference line 8, viz. the section A-D, is divided into sections a' and b', which again bear a ratio of 0.168. At that time there are two as yet unintersected sections which are equally large, viz.- B-D and D(E)A. Upon a constant track shift over a distance a, the fourth intersection will be located in the section D(E)A at E and this section will be divided into sections a'' and b'' with a mutual ratio of $\approx$GS. Now the largest as yet undivided section is section B-D and upon a shift from E over a distance a, the fifth intersection will be located in the section B-D at C and with a division ratio of $\approx$GS.

The largest as yet unintersected sections will then be A-B, B-C and D-E, which upon subsequent track shifts over the distance a will be divided according to $\approx$GS at subsequent passages of the track.

Figure 6A:
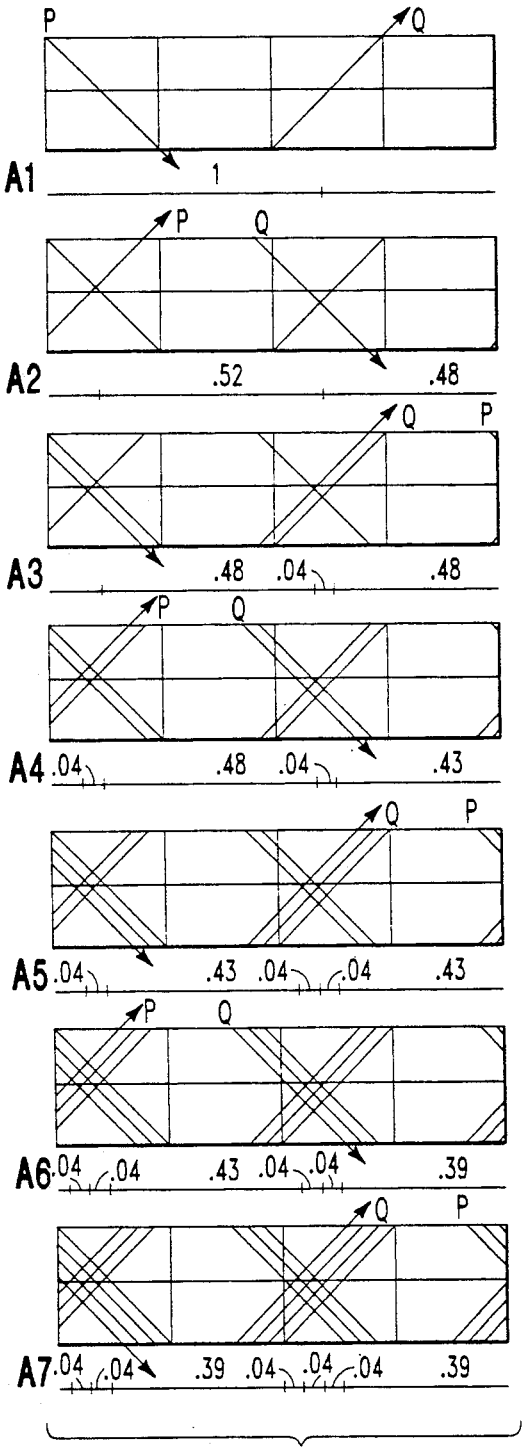
FIGS. 6A and 6B schematically show the respective track patterns of a conventional machine and a machine according to the invention, on four vertical walls of a square tank, as it would be applied stepwise during the first 3.5 revolutions of two nozzles about the horizontal axis of rotation.

FIG. 6A is a stepwise representation of the pattern as it is formed during the first 3.5 tracks on the vertical walls of a square tank in a conventional machine having two nozzles which are arranged diametrically opposite each other, the pattern accordingly starting simultaneously at two points in the tank. The thick lines in the Figure indicate the pattern of the latter half track of the two nozzles, the letter P indicating one nozzle and the letter Q indicating the other. Shown separately under each panel is the equator chosen as a reference line with the points where and by what fractions this line is intersected by the track pattern. The part of each track that goes up (P) is chosen as a point of reference. FIG. 6A shows a part of the composition of the first subcycle of the track pattern according to FIGS. 3 and 4.

Figure 6B:
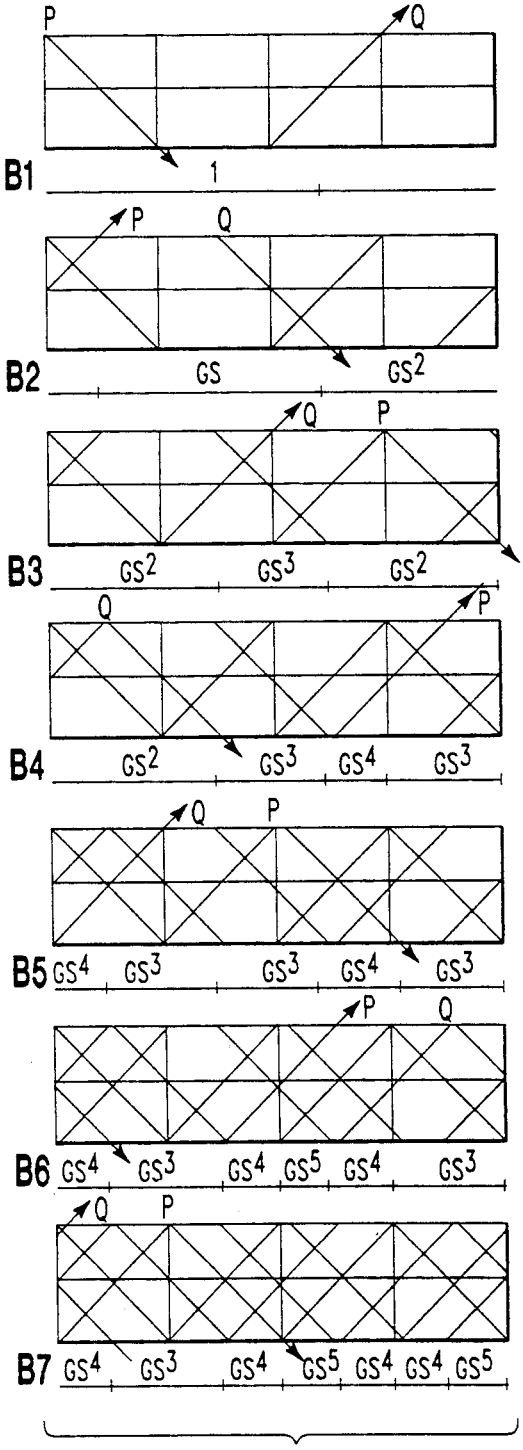

Similarly, FIG. 6B shows the corresponding track pattern in a machine according to the invention. The fraction specified is expressed as a part of the total length of the reference line and as a power of the Golden Section number GS. The higher the power, the smaller the intersection fraction. In FIG. 6B3 the reference line is divided into two large line sections with fraction $GS_2 \approx 0.382$ and a short line section $GS^3 \approx 0.236$. In the next two panels 6B4 and 6B5 the large line sections are divided by different nozzle jets into sections of $GS \times GS^2 = GS^3$ and $(1-GS) \times GS^2 = GS^4 \approx 0.146$. Then (see FIG. 6B5) there are two small line sections $GS^4$ and three large sections $GS^3$.

Figure 7:
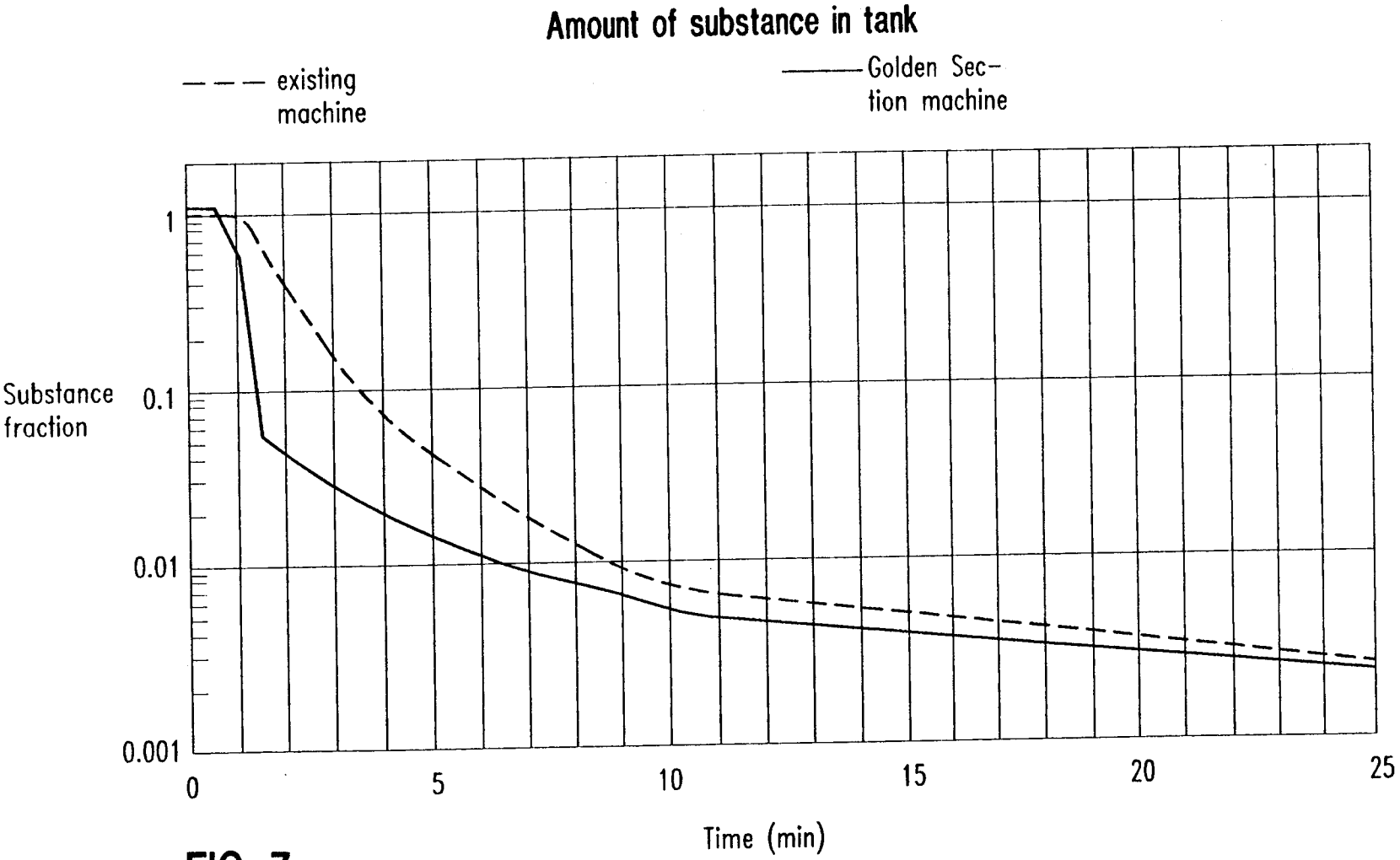
FIG. 7 plots the decrease in time of the amount of as yet unrinsed material in a test tank during washing with a conventional machine and with a machine according to the invention.

In the next three revolutions, of which two are shown in FIGS. 6B6 and 6B7, the three largest line sections are further divided into sections of $GS^4$ and $GS^5$.

FIG. 6 clearly shows that the method according to the invention more rapidly accomplishes a uniform track pattern across the entire tank wall, which pattern is uniformly densified across the entire tank wall.

Figure 4D:
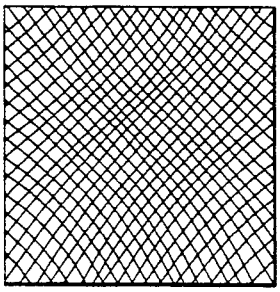

In this example the conventional machine will have made a uniform pattern as shown in FIG. 4A only after 22 half revolutions (actually 22.5). Only after another 68 half revolutions the pattern is uniform again, viz. as shown in FIG. 4D.

FIG. 7 plots as a function of time the calculated as yet unrinsed quantity of an easily removable substance in a test tank during washing for a conventional machine and for a machine modified according to the invention. The amount of substance that remains behind has been calculated from the measured content of the substance in the rinsing water pumped from the tank. The plots clearly show that in the machine according to the invention, especially at the beginning of the cycle, much more substance is removed from the tank than in the conventional machine.

I claim:

1. A method of cleaning a storage or transport tank by spraying a cleaning agent against the interior wall using at least one spray nozzle, said nozzle making a rotating movement in a plane, while said plane is simultaneously revolved around an axis which makes an angle with the axis of rotation of the nozzle, the point of impingement of a jet of cleaning agent delivered by the nozzle describing a track over the interior wall of the tank, said track passing a plurality of times a continuous circumferential line on the wall of the tank, which line is chosen as a reference, characterized in that the nozzle is so driven that the impingement track passes the circumferential line substantially in the greatest as yet unintersected portion of said circumferential line, which portion is located between earlier points of intersection of the impingement track and said circumferential line, namely, at distances from said earlier points of intersection which substantially bear a ratio of $1:(\frac{1}{2}\sqrt{5}-\frac{1}{2})$.

2. A method according to claim 1, characterized in that the impingement tracks form a pattern, there being, viewed in time, at least four moments when the average density of the line pattern has increased by a factor substantially equal to $(\frac{1}{2}\sqrt{5}-\frac{1}{2})$, this pattern being uniform in the sense that the reference line is intersected forming sections substantially bearing a ratio of $1:(\frac{1}{2}\sqrt{5}-\frac{1}{2})$.

3. A method according to claim 1, characterized in that at the latest in the fourth period of the rotating movement of the spray nozzles an intersection of the reference line by the impingement tracks of the jets of cleaning agent takes place such that the space between two preceding points of intersection is divided into sections the dimensions of which substantially bear a ratio of $1:(\frac{1}{2}\sqrt{5}-\frac{1}{2})$.

4. A method according to claim 3, characterized in that the impingement tracks form a pattern, there being, viewed in time, at least four moments when the average density of the line pattern has increased by a factor substantially equal to $1:(\frac{1}{2}\sqrt{5}-\frac{1}{2})$, this pattern being uniform in the sense that the reference line is intersected forming sections substantially bearing a ratio of $1:(\frac{1}{2}\sqrt{5}-\frac{1}{2})$.

5. Apparatus for cleaning the interior wall of a tank or similar container, comprising spray nozzles which are rotated around two mutually perpendicular axes, wherein the ratio between the circumferential velocities of the at least partial, rotational movements of these axes being constant, characterized in that the ratio of the circumferential velocities $T_v:T_h$ is substantially equal to $1:(\frac{1}{2}\sqrt{5}-\frac{1}{2})$.

* * * * *